United States Patent [19]

Hopper

[11] Patent Number: 4,732,215

[45] Date of Patent: Mar. 22, 1988

[54] SUBSEA OIL PRODUCTION SYSTEM

[75] Inventor: Hans P. Hopper, Whiterashes, Scotland

[73] Assignee: British Petroleum Company PLC, Middlesex, England

[21] Appl. No.: 858,754

[22] Filed: May 2, 1986

[30] Foreign Application Priority Data

| | | | |
|---|---|---|---|
| May 4, 1985 | [GB] | United Kingdom | 8511440 |
| May 4, 1985 | [GB] | United Kingdom | 8511441 |
| May 4, 1985 | [GB] | United Kingdom | 8511442 |
| May 4, 1985 | [GB] | United Kingdom | 8511443 |
| May 4, 1985 | [GB] | United Kingdom | 8511446 |
| May 4, 1985 | [GB] | United Kingdom | 8511448 |
| May 4, 1985 | [GB] | United Kingdom | 8511449 |

[51] Int. Cl.[4] ..... E21B 43/017

[52] U.S. Cl. ..... 166/366; 166/341; 166/360

[58] Field of Search ..... 166/338–342, 166/351, 360, 364, 366, 368, 335, 370; 175/5, 7

[56] References Cited

U.S. PATENT DOCUMENTS

| | | | |
|---|---|---|---|
| 3,099,316 | 7/1963 | Johnson | 166/368 X |
| 3,165,899 | 1/1965 | Shatto, Jr. | 166/335 X |
| 3,877,520 | 4/1975 | Putnam | 166/366 |
| 4,094,159 | 6/1978 | Hettinger | 166/356 X |
| 4,192,383 | 3/1980 | Kirkland et al. | 166/341 |
| 4,194,857 | 3/1980 | Chateau et al. | 166/339 X |
| 4,214,842 | 7/1980 | Franks | 166/349 X |
| 4,405,016 | 9/1983 | Best | 166/347 X |
| 4,437,521 | 3/1984 | Richardson et al. | 166/366 X |
| 4,438,817 | 3/1984 | Poklandnik et al. | 166/341 |
| 4,589,493 | 5/1986 | Kelley et al. | 166/341 |
| 4,625,805 | 12/1986 | Ladecky | 166/360 X |
| 4,625,806 | 12/1986 | Silcox | 166/368 X |

*Primary Examiner*—Stephen J. Novosad
*Assistant Examiner*—David J. Bagnell
*Attorney, Agent, or Firm*—Morgan & Finnegan

[57] ABSTRACT

A sub-sea oil production system has a three-dimensional template with a framework of vertical and horizontal members. These members enclose one or more production bays each of which has a well slot and a manifold slot. Within each bay a well tree module may be installed vertically above the well slot and a manifold module vertically above the manifold slot, with a production bridge module linking them. The template and the modules are designed to be transported and installed by a semi-submersible drilling rig without the use of divers or guidelines. All access points are at the top of the modules so that the modules can be inspected, tested and serviced by a remotely operated vehicle, which can perch on raised guides on the top of hinged covers of the framework.

11 Claims, 16 Drawing Figures

Figure 1:
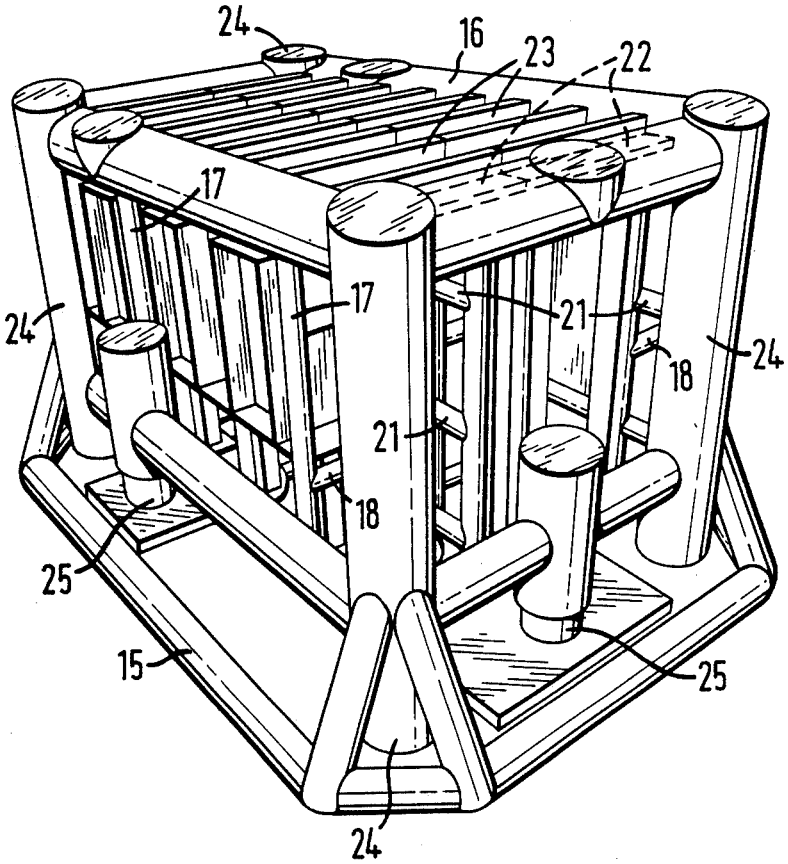

117
131
131
118
118
132
116
132

SUBSEA OIL PRODUCTION SYSTEM

This invention relates to a subsea oil production system using a compact, modular template.

Subsea production systems are known using a template to provide drilling slots and a framework on which to mount the oil production equipment. Up until now such templates have been relatively bulky with the individual wells fairly widely spaced to allow for the installation of a drilling blow out preventor (BOP) and side access for inspection, testing and servicing of the production equipment. They have been transported to site on barges and lowered to the sea bed by crane. Although remotely operated vehicles (ROVs) are also known for inspecting, testing and servicing the production systems, water depths, up until now, have nearly all been such that the systems have been accessible to divers.

As the water depths in which oil is found and produced increase, totally diverless and guidelineless systems will be needed. Water depths may eventually increase to a point where lowering templates by crane may become impracticable. Even in shallower depths, diverless and guidelineless systems could be economically attractive.

The present invention uses a compact, modular template which can, if necessary, be handled solely by a semi-submersible drilling rig. Thus the template could be transported to the site, slung beneath a drilling rig between its pontoons, lowered to, and levelled on the sea bed by the rig. All operations to drill wells and place and fix the necessary production equipment on the template may also be carried out by the drilling rig.

According to the present invention a template for a subsea oil production system has a three-dimensional framework enclosing one or more rectangular production bays, each bay having a well slot and a manifold slot with, within the framework, space above the well slot for a tree module, with, also within the framework, space above the manifold slot for a manifold module and with further space above the blocks for a production bridge module linking the other modules.

The top of the framework of each bay may have a moveable cover. In the case of a multi-bay framework there may be a unitary, modular pipework assembly linking the manifold modules at their base. The framework surrounding each module provides alignment, orientation and guidance for lowering and installing the tree and manifold modules and the production bridge module and also the pipework assembly. The framework may also be used to lower and install an extension spool on the well head to assist drilling operations.

Each of the modules and components to be placed into the template framework may themselves have a framework which assists in guiding the units into the template framework in a self-aligning and self-orientating manner. Releaseable tools may be used to lower the units and they themselves may also have a self-aligning and self-orientating framework to achieve guidance for retrieving operations.

Since the template framework takes the internal loads and bending moments of the modules, the module frameworks may be relatively light, thereby keeping the overall weight of the modules within reasonable limits.

The template and modules fitting into the framework will now be described in more detail using, for convenience, the likely sequence of operations for installing a complete sub-sea system.

A template having the required number of production bays and with the bays in the desired relationship may be assembled on land. The rectangular production bays are preferably placed side by side in a single row, or in two rows in the case of larger systems. Other arrangements are also possible, however, e.g., two or four bays surrounding a central oil collection unit, which may be a "dummy" wellhead. The assembled template may have three or more levelling jacks at or near its periphery and four or more pile guides, usually at the corners.

Each production bay may be of standard API guidepost dimensions, e.g., each rectangular bay may be two standard API units with framework in the lower half of such bay subdividing it into square tree and manifold units. Each tree and manifold module may be slightly less than the API guidepost spacing so that they fit into the template framework.

The template may have a separate moveable cover over each bay. The covers may be hinged to the outside framework of the template or they may be of concertina design so that, within suitable guides, they may be pushed to the edge of the framework and folded as they are pushed.

The template may be moved by barge to a semi-submersible drilling rig. The barge is then positioned underneath the rig between the pontoons and the template lifted from the barge. The barge is removed and the template secured between the pontoons. This transfer can take place in any sheltered location. The rig, with the template on board, then moves to the oil production location.

The template is then slung from riser pipe and lowered to the sea bed. It may be levelled on the sea bed by the rig using a template levelling device described and claimed in UK Patent Application No (Case 6128) filed simultaneously with this application, and claiming priority from UK Patent Application No 8511605 filed on 8th May 1985.

The levelled template is then fixed to the sea bed by drilling through the pile guides and fitting and cementing piles. Any suitable piles may be used e.g., hydraulically locked piles as supplied by British Underwater Engineering Ltd.

Drilling is commenced using a well slot in one of the production bays. The cover for the particular bay to be drilled may be lifted or displaced by a remotely operated vehicle (ROV) described in more detail hereafter. Standard drilling and casing practice may be used starting with eg 30 inch casing, then 20 or 18⅝inch casing and so on using a 30 inch housing and a 18¾inch well head. At the point in the drilling operation after running the 30 inch housing an extension spool is lowered into the template framework to fill the space above the well head housing.

The extension spool comprises a lower, square base plate fitting into the template sub-bay framework with a hydraulically lockable connection to the housing. The corners of the base plate may have a framework of chamfered posts to assist in aligning and orientating the spool so that it is orientated and aligned within the template framework. A drill guide tube extends above the lower base plate to an upper plate, the length of the spool being such that the top of the upper plate is above the template. This upper plate may also be square with chamfered posts for guidance into the template framework.

It is fitted with suitable hydraulic stabs for operating the connector, and soft landing jacks. It has a connector hub profile for a blowout connector and may have guideposts above it for guiding the blowout preventor (BOP) onto the extension spool, or a suitable cone compatible with a guidelineless BOP. Mechanical override rods may run between the upper and lower plates outside the drill guide tube to provide the secondary release system for the spool's hydraulic connector.

The blow out preventer thus sits above the template framework on the extension spool and is not subject to the size constraints of the template itself. Nor is its orientation dictated by the rig. Any suitable form of blow out preventer may be used, the extension spool upper plate being designed to accept the particular type of blow out preventer chosen.

The base plate may have two or more two-step soft landing jacks.

The extension spool may be assembled on the drilling rig and lowered on riser pipe into the template. The two step soft landing jack halts the extension spool a few inches above the well head, the landing being completed hydraulically while part of the weight is taken by the drilling rig compensator.

When the blow out preventer is to be used, it is lowered onto the installed extension spool and all parts locked.

It is to be understood that the sequence of operations in respect of each production unit can be carried out in any order. Each production unit could be completed before moving to the next production bay. Normally, however, the wells of all bays can be drilled and cased before proceding to the next installation step, the covers for the modules being lifted or displaced as necessary.

The wells are drilled, cased and completed using a tubing hanger which has a central body surrounded by an annulus with an annulus shutoff sleeve. The central tubing will normally be for oil production, but could be used for water injection. The annulus will normally be for injection of other fluids or gas or for monitoring, as is standard practice.

Manifold selector heads may then be placed on the manifold slots. In a multi-production unit template the manifold selector heads may be part of the unitary pipework assembly linking the manifold blocks. Each selector head will be of concentric form with a central hollow body and an annulus. The pipework assembly may have four pipes linking each of the selector heads, these four pipes being used to carry oil away from or to bring other liquids into the subsea production system. Pipes for oil production and water injection will clearly be necessary; the other pipes may be a test line feeding into the annulus of the selector head and a chemical injection line feeding into the central production tube. Also included may be hydraulic portings to control the production unit.

The selector heads may be mounted to the pipework to allow slight flexing of the assembly to assist in latching the selector heads onto the manifold slots. Once mated with the slots they may be locked in with e.g., a latch ring which may have the capability of being unlocked by a running tool connector.

The pipework assembly and selector heads may, however, be mounted into the template before it is lowered to the sea bed.

A particular feature of the manifold selector head is a sleeve in the head which covers or exposes ports and which allows a well to be used either for production or water injection. Initially the sleeve used will have the profile for the desired well use (e.g., for oil production), but if, after a period, a change of use is desired (e.g., to water injection), the sleeve in the selector head may be lifted by a suitable work vessel, and changed to a different profile to expose the port now required and cover the other.

The next operation will normally be to fit a tree module to each well head.

The tree module will have, in conventional fashion, upper and lower master valves for the central production tube and the annulus. These valves are, preferably, at 90° to the production bay axis. The lower valves may be used to isolate the wells, the upper valves being those in normal use. It will also have a hydraulically operated connector to the well head and all the necessary additional equipment to allow for inspection, servicing and testing using a remotely operated vehicle. Thus it will have vertical mechanical actuators for the valves so that the valves can be operated and locked in a set position irrespective of the well bore pressure, and hydraulic control line isolation valves, all capable of actuation by a ROV.

Particular novel features of the tree module are the guidance framework for the module and vertical lines and rods which enable all valves to be mechanically operated and all functions tested from the top of the tree rather than from the side, as is more conventional The guidance framework is a rectangular framework with a square base plate and a square upper plate, with tubulars at each corner linking the plates and with chamfered post portions above and below the plates. If the tree module is lowered so that, as it reaches the template, it is diagonal to the production bay which it is required to enter, the tree module partially enters the bay until the chamfered corners stop it. The chamfers acting on the frame orientate the tree module until it is square on to the template framework and the whole tree module can then enter the production bay. On entering the template framework the module is vertically aligned and guided.

A tree module running tool is used in association with the tree module to assist in lowering. This is connected to the top of the tree module by a releasable hydraulic connection, has a guidance framework, soft landing jacks, and an extension arm which extends across the manifold part of the production bay and helps with alignment.

The upper and lower master valves for the block production tube and the annulus project sideways from the central tree block without extending beyond the framework. Vertical actuating rods run up from the valves to near the top of the template to allow the valves to be mechanically operated by ROV.

Vertical mechanically operated connector rods run between the upper and lower plates to allow for mechanical override of the hydraulic connector latching the tree module to the well-head.

Two or more soft landing jacks are included at the base of the tree module, operating in the same way as the jacks on the drilling extension spool.

The tree module, and tree module running tool may be lowered by riser pipe. The tree module's hydraulic connector locks it on to the well head and once locked, the tree module running tool may be released from the tree module and withdrawn.

All tree modules can be fixed in succession if desired. The manifold modules are then lowered and locked to the manifold selector head. The manifold modules are similar in design to the tree modules having valves mounted in a similar block. These valves will be upper and lower production and annulus valves, a crossover valve to allow liquid transfer from the production side to the annulus side or vice versa, and a chemical injection valve. As with the tree module all valves have vertical mechanical rods with inner position indicator rods extending up to a point near the top of the template frame.

The manifold module has the same aligning and orientating framework as the tree module. It is lowered using the same tree module running tool and has, therefore, the same upper hub hydraulic system. The manifold module connector locks and seals into the manifold selector head.

The running tool is also released from the manifold module and withdrawn in the same way.

It should be emphasised that the use of a concentric tubing hanger and concentric production and annulus tubes in the tree and manifold modules allows the valves to be offset and the diameter of the modules to be reduced. In a more normal dual completion, valves have to be in line requiring lower ones to extend out sideways to be accessible for remote operation using a remotely operated vehicle. Further, the concentric design allows the valves in the production bridge module (described hereafter) to be at 90° to the valves in the tree and manifold modules, again helping to produce a slim design.

The tree and manifold modules are then linked by a production bridge module which serves to connect the production and annulus sides of the tree module to the corresponding production and annulus sides of the manifold module.

The bridge is thus formed of an upper tree block and an upper manifold block connected by pipework which allows a degree of alignment freedom. The upper tree block is fixed into a framework and the upper manifold block into a separate framework, giving the blocks a certain freedom of movement to help in location.

The upper blocks are hydraulically locked to their appropriate tree or manifold module and the whole production bridge module is lowered using the same module running tool as was used for the previous two installations. The module running tool is releasably fixed to the rigid upper tree block and since there is now an upper manifold block extending sideways from the upper tree block it may be necessary to move the point of attachment of the tree running tool to the riser pipe so that it remains over the centre of gravity of the production bridge module.

In the upper tree block of the production bridge are additional valves, in particular production and annulus swab valves, and also a production wing valve, all with vertical mechanical ROV operating rods.

At the top of the upper manifold tree block is an insert choke. Also in the manifold block, upstream of the choke, is a port for injecting chemical fluid into the production fluid.

The production bridge will also have the required hydraulic lines, control valves and valve indicators and overrides. Thus in the upper manifold block may be a control panel with electrical and hydraulic connections. These may be high pressure hydraulic lines for the control of downhole functions and units and low pressure control lines for the control of all functions in the tree and manifold modules and the production bridge module (including the choke).

Since the production bridge module extends along the whole length of a production bay of the template the upper part of each bay has no template cross-frame subdividing it as in the lower part of the module. The production bridge module may, however, have a cross member on it between the two upper blocks at a height and in a position to complete the template framework. A complete framework is desirable so that guidelineless orientation and alignment is possible for subsequent running operations, described hereafter, e.g., running a high pressure cap, an insert choke or a W/L BOP subsea lubricator.

The final main assembly step is to place a high pressure cap on the top of the upper tree block. A separate, smaller, running tool may be used to lower and lock this cap into place. This same tool may also be used to change the insert choke on the top of the manifold block.

As previously indicated, the template frame may have moveable covers, two half-covers being provided for each production bay. The covers may have raised guides on their upper surfaces extending parallel to the length of each production bay. These guides can then be used as perches for a ROV so that the ROV can perform any necessary inspection, servicing or testing tasks on the equipment of an adjacent bay.

Figure 4:
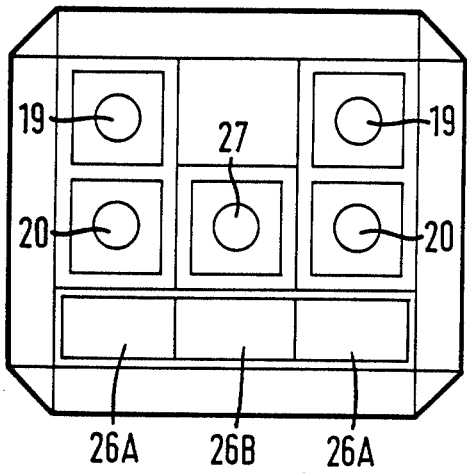
Figure 5:
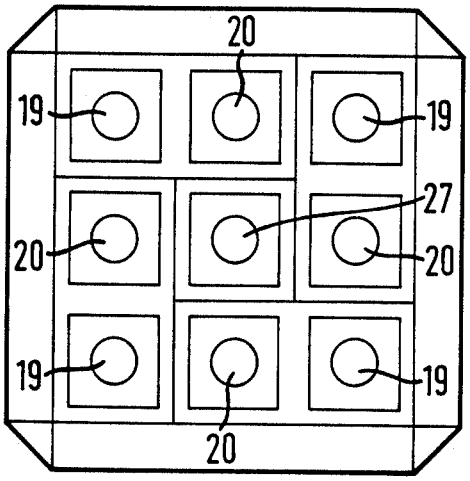
Figure 6:
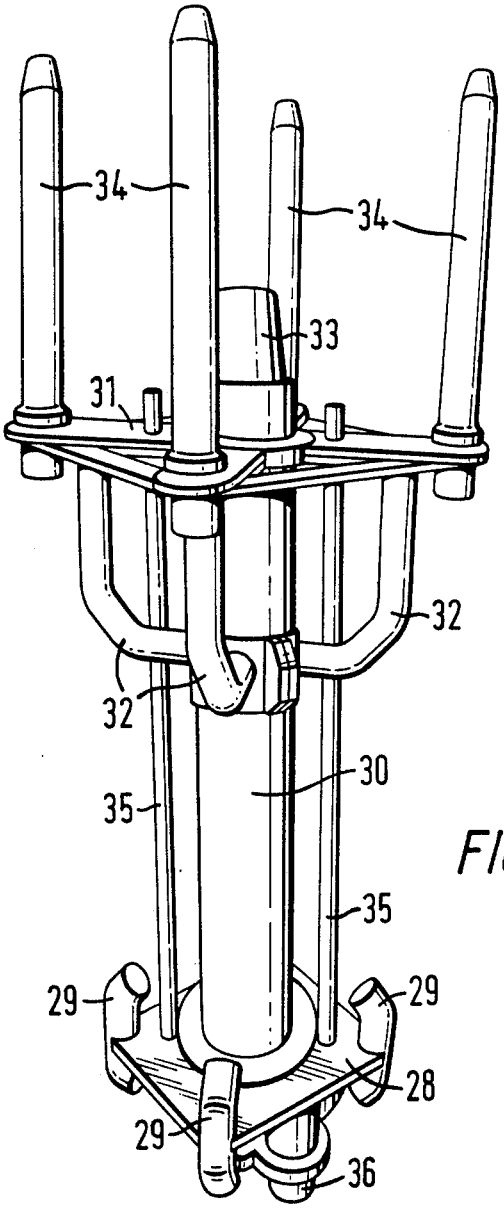
Figure 7:
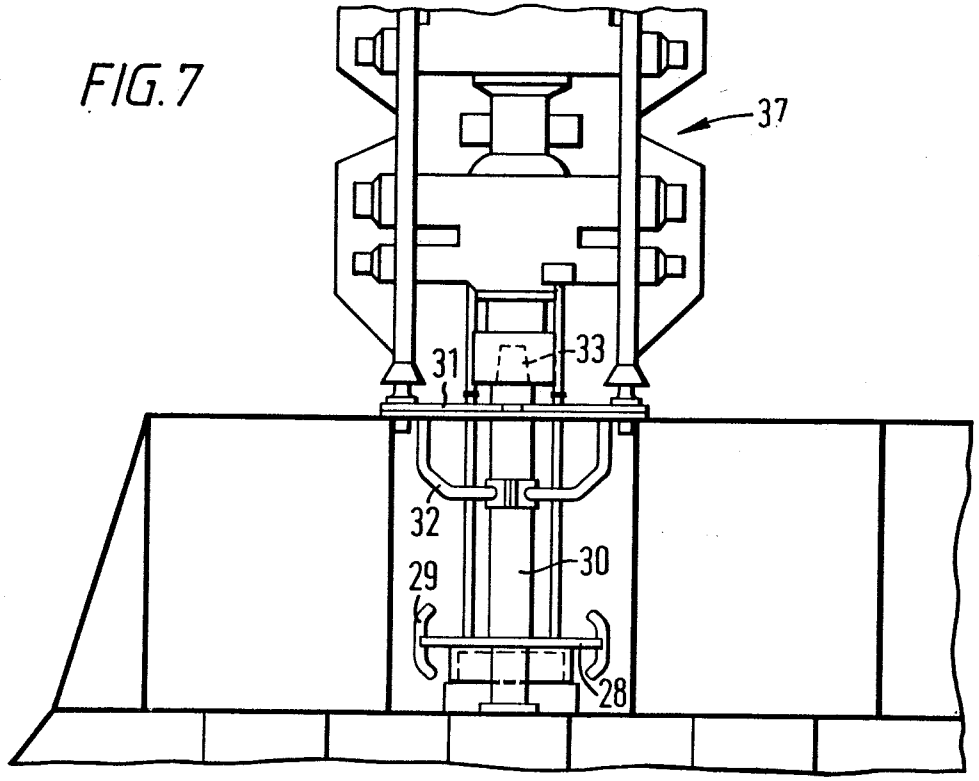
Figure 8:
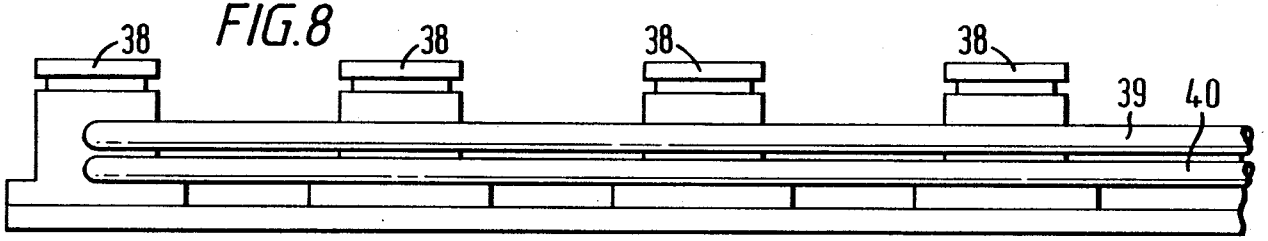
Figure 9A:
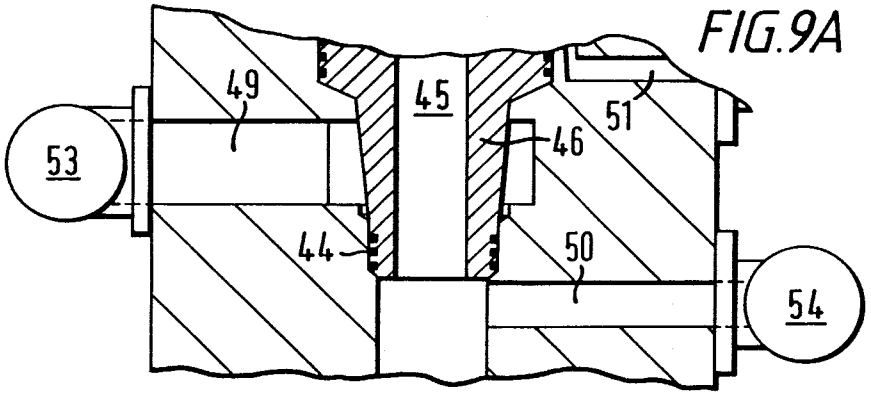
Figure 9:
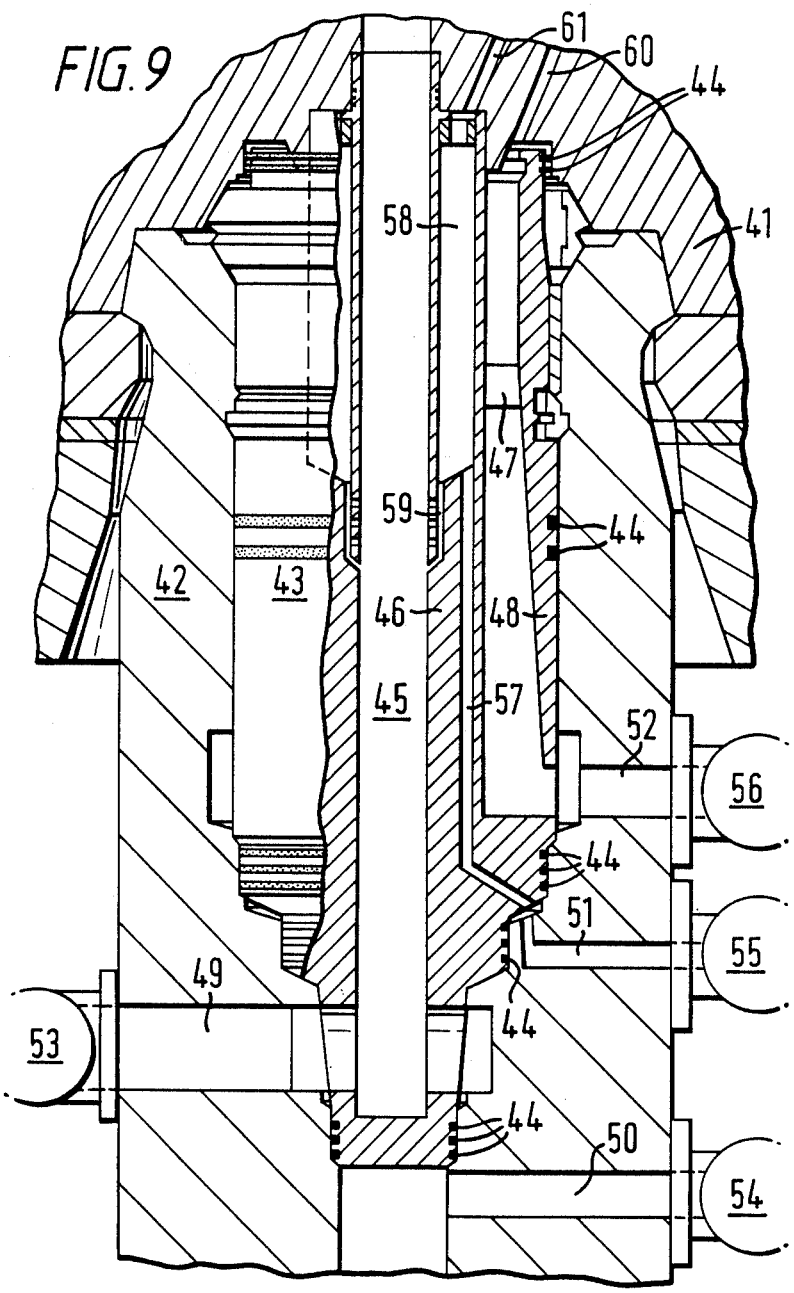
Figure 10:
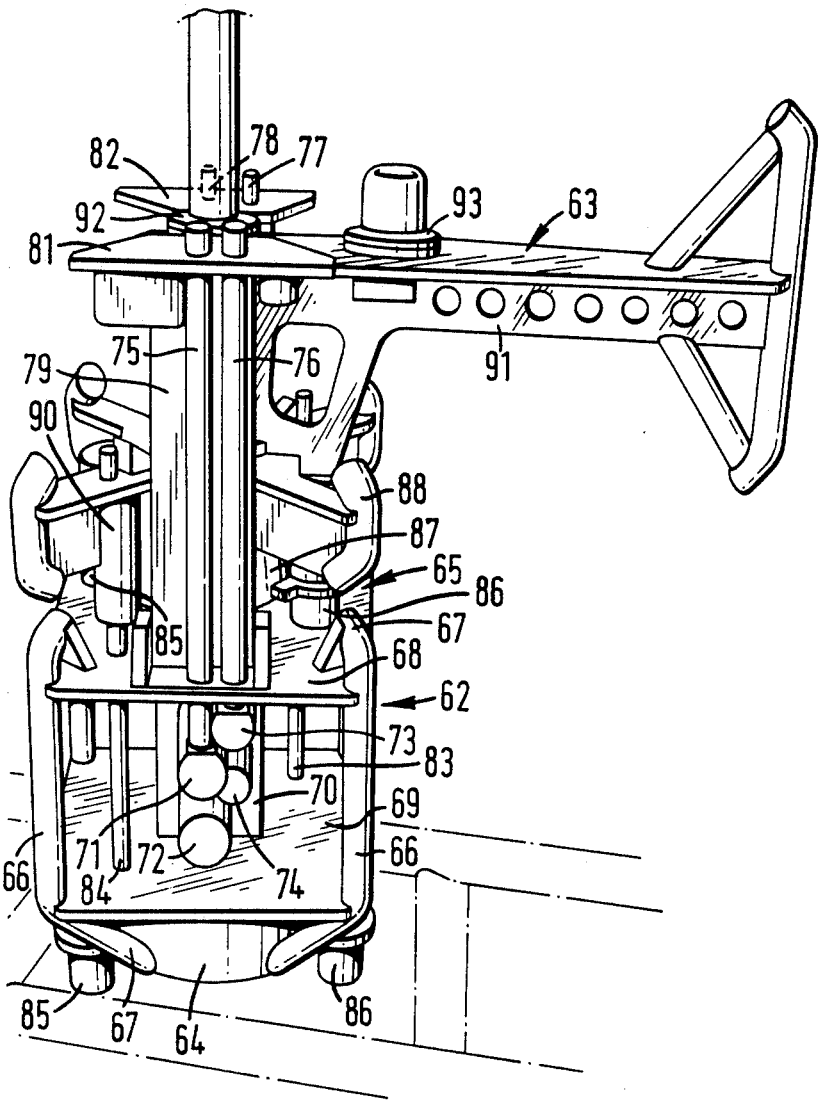
Figure 11:
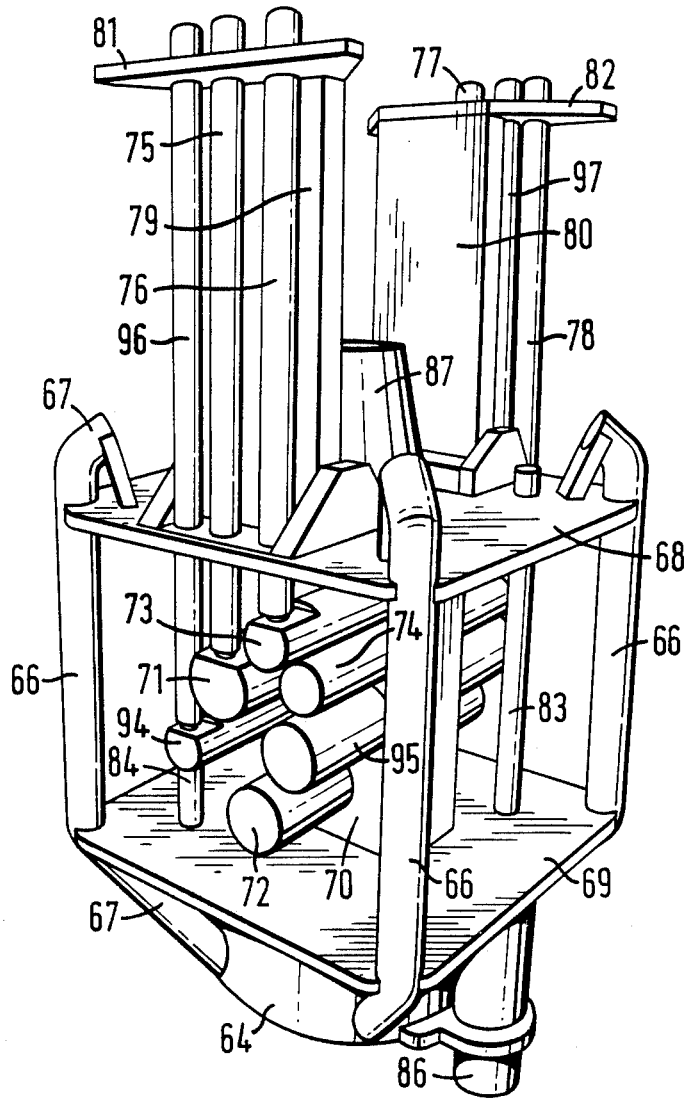

The subsea production system described generally above may have suitable control lines (e.g., hydraulic lines) connected to it and the pipework assembly may be connected to suitable pipework carrying away oil to an oil collection pipeline system or other collecting point, and allowing injection water or chemical injection or testing fluids to be supplied to the system. The invention is specifically described with reference to the accompanying drawings, in which FIG. 1 is a three-dimensional view of a three production bay template, FIGS. 2, 3, 4 and 5 are diagrammatic plan views of alternative bay assemblies for templates, FIG. 6 is a three dimensional view of an extension spool and FIG. 7 is a diagrammatic view showing an extension spool in position with a BOP above, FIG. 8 is a diagrammatic view of a pipework assembly, FIG. 9 is a part-section through a manifold selector head showing the selector sleeve, and FIG. 9A shows part of an alternative selector sleeve which could be substituted for the selector sleeve of FIG. 9, FIG. 10 is a three dimensional view of a tree module with associated running tool, FIG. 11 is a three dimensional view of a manifold module.

Figure 12:
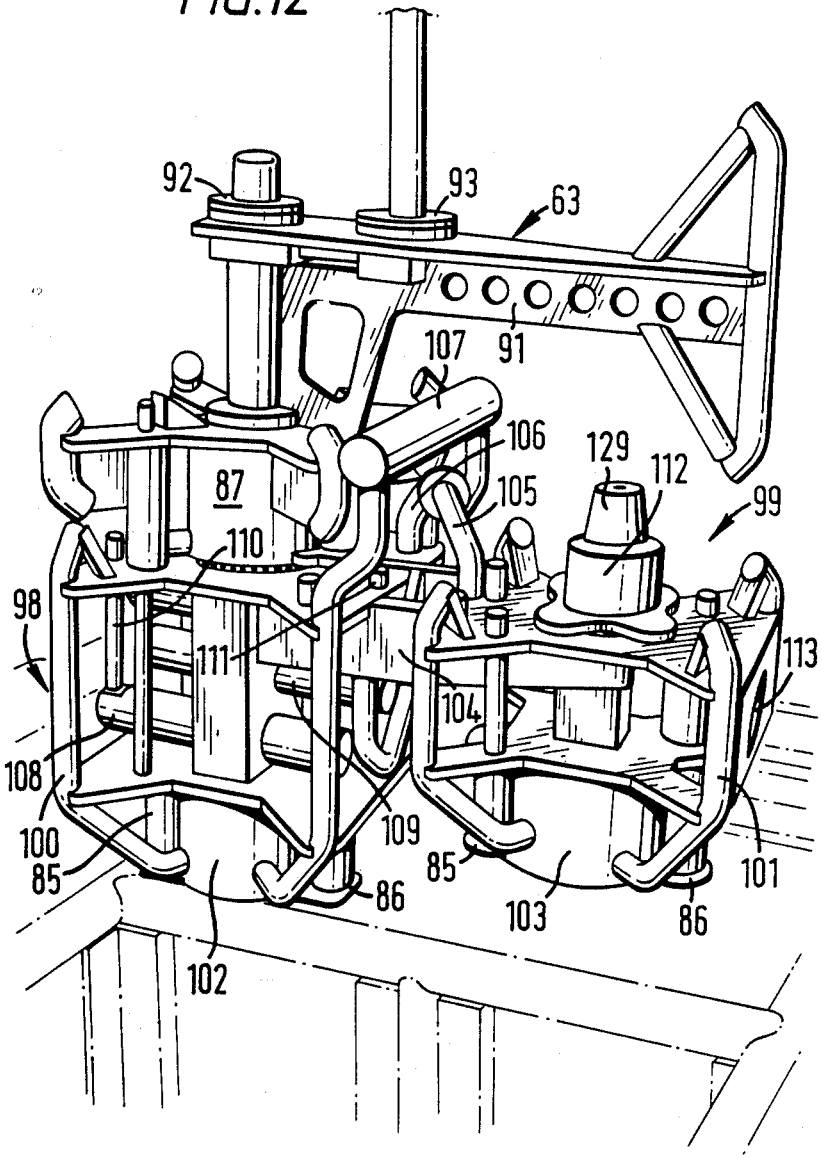
Figure 13:
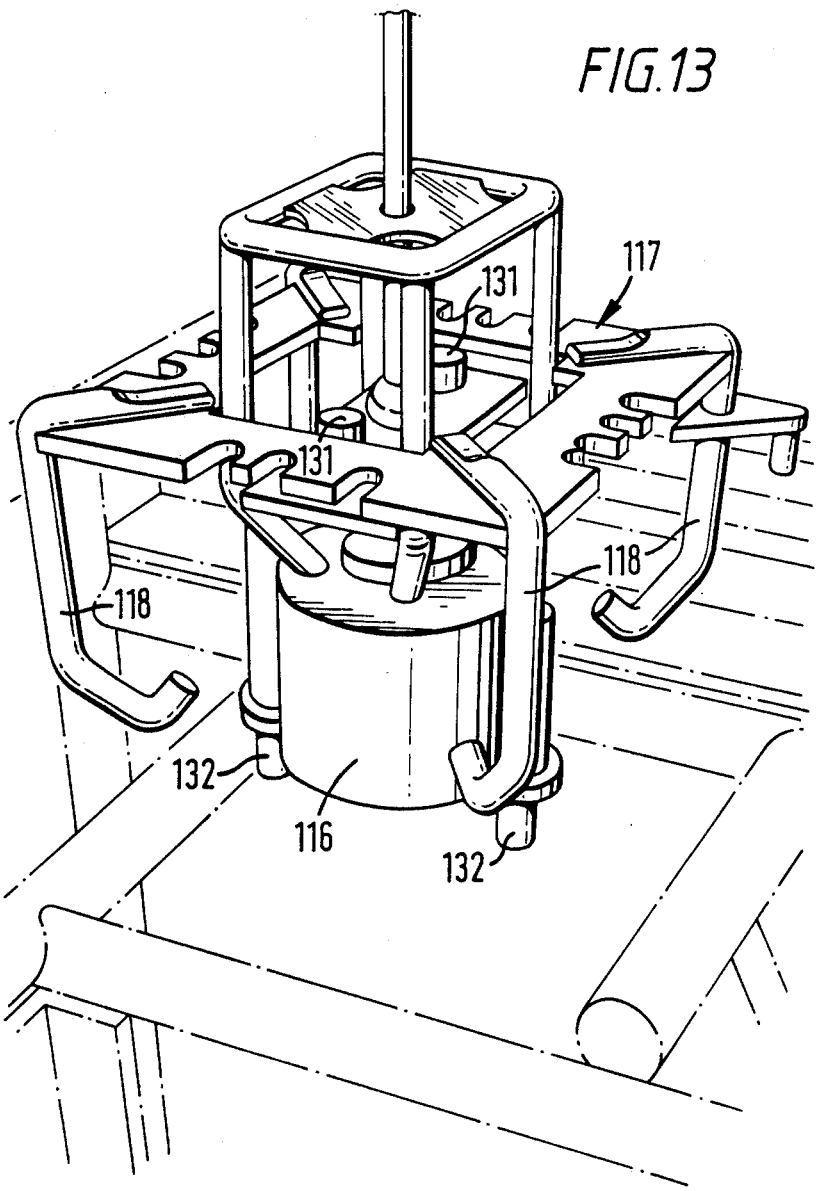
Figure 14:
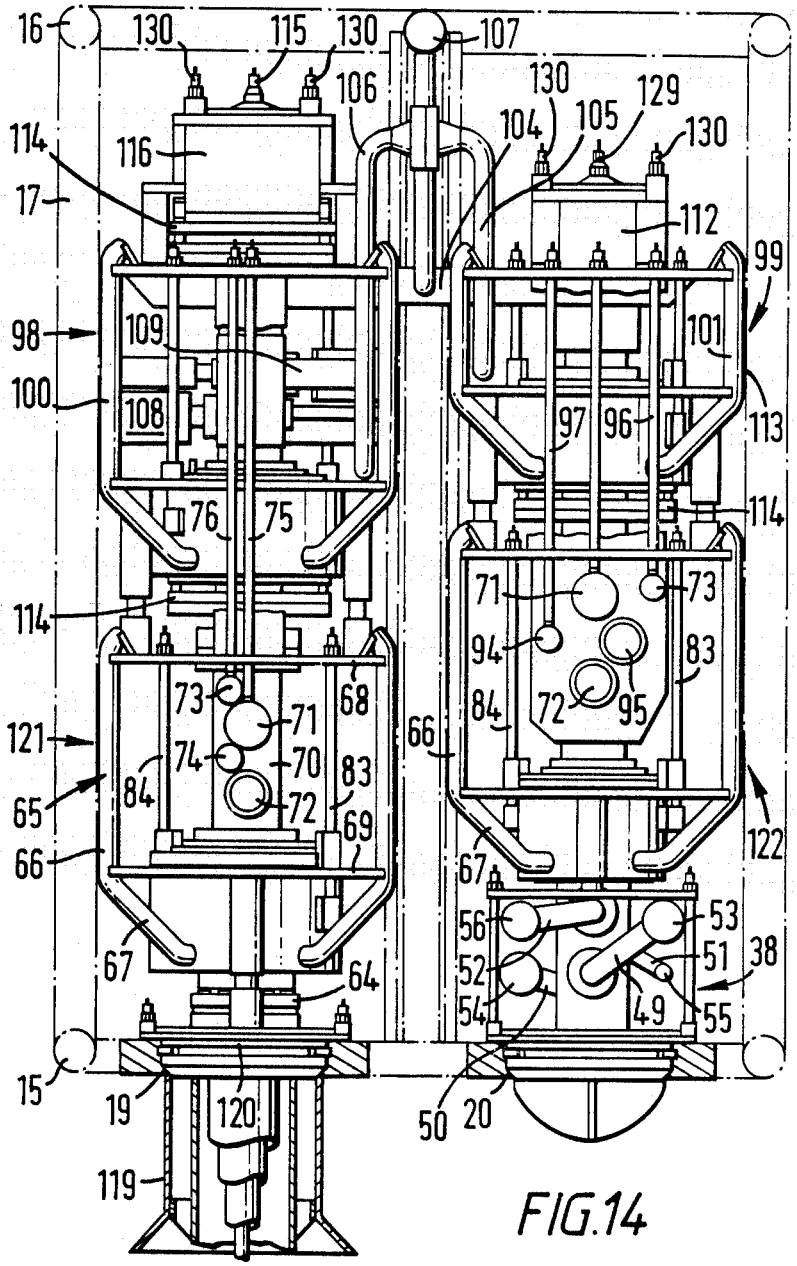
Figure 15:
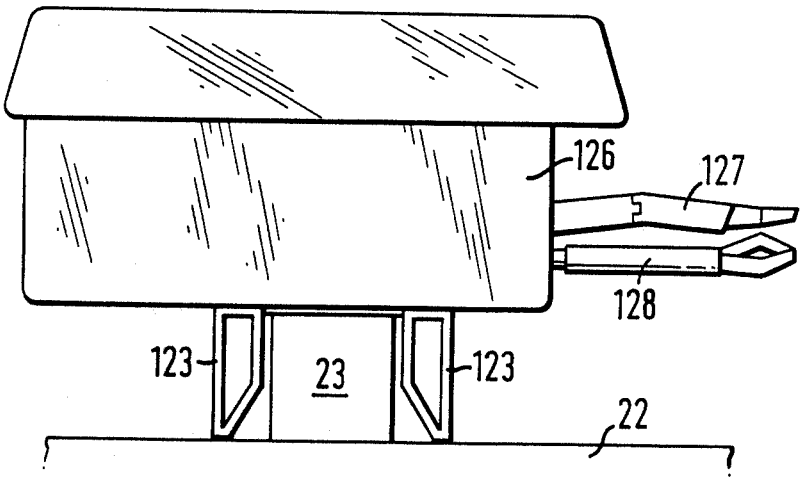
Figure 16:
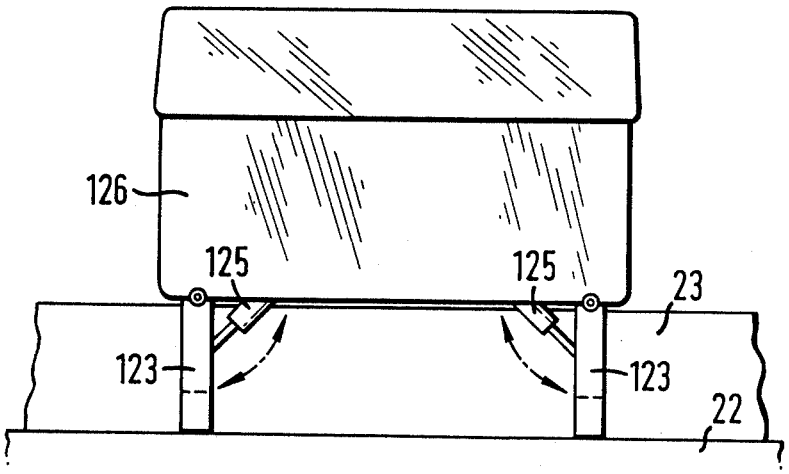

FIG. 12 is a three dimensional view of a production bridge module with associated running tool, FIG. 13 is a three dimensional view of a high pressure cap for the tree block with its associated component running tool, FIG. 14 is a side view of an assembled module, and FIGS. 15 and 16 are side and rear elevations of a ROV and guideframe.

In FIGS. 1 to 5, a template is formed of a rigid three-dimensional framework with a main exterior base frame 15, a top frame 16, a vertical stanchions 17. This main frame is sub-divided into three production bays by crossframes 18 at top and bottom and at the midpoint, giving 3 side-by-side bays. Each bay has a well slot 19 and manifold slot 20 at its base and there are cross frames 21 at the base and the mid point (with respect to the height) sub-dividing each bay into two sub-bays. The top of the frame has two half-covers 22 for each bay, hinged to the top frame 16. Each half cover has two raised guides 23 on its upper surface. There are four pile guides 24 (one at each corner) and three self-levelling jacks 25 (two at adjacent corners and one midway along the opposite side).

Figure 2:
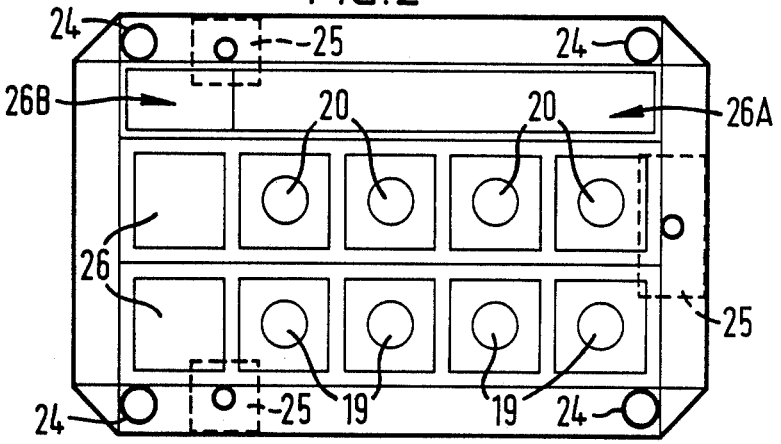
Figure 3:
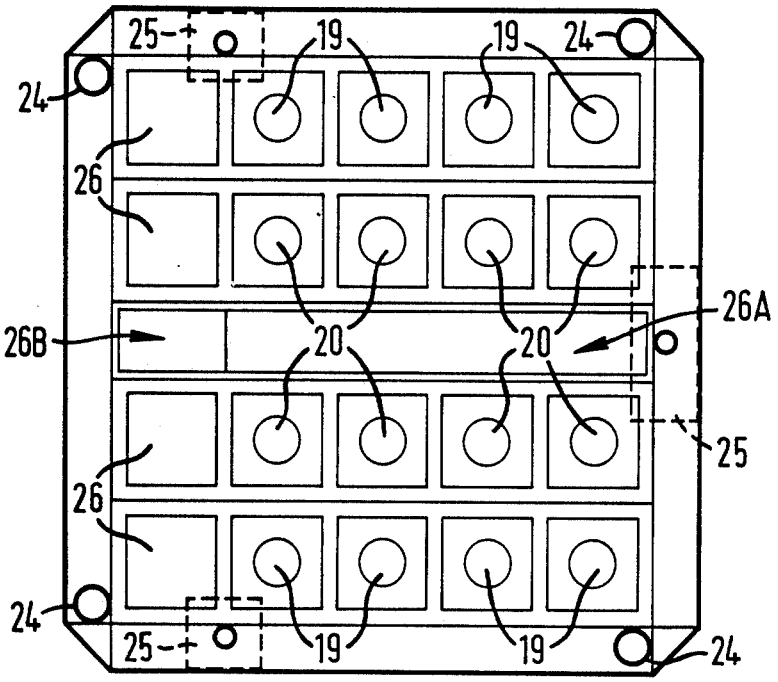

FIG. 2 shows a four bay assembly similar to that of FIG. 1 but with four bays. FIG. 3 shows an eight bay assembly (essentially two back-to-back four bay assemblies), FIG. 4 a two bay assembly and FIG. 5 an alternative form for a four bay assembly. In FIGS. 2 and 3 further bays 26 at the end are for connecting pipelines from the manifold sides of the modules to pipelines and umbilicals to carry away oil production from the template or bring in injection water, chemical fluid or other necessary fluids (e.g., hydraulic fluids). In FIGS. 4 and 5 the manifolds are connected to a "dummy" wellhead 27 to carry away oil and bring in fluids as necessary.

In FIGS. 2, 3 and 4, there are also bays 26A adjacent the manifold sub-bays which can be used for control equipment and control lines for each production bay. Bays 26B can be used for bringing in umbilicals and connecting them to the control equipment in bays 26A.

No control or umbilical bays are shown in FIG. 5; other means for bringing in umbilicals and housing control equipment may be used, e.g., in the dummy well head area 27.

Each bay consists of two 8 feet 6 inch square standard API sub-bays.

FIG. 6 shows an extension spool formed of a base plate 28, which chamfered posts 29 at each corner. This base plate has a hydraulically lockable connection (not shown) to the well head. A drill guide tube 30 has a flanged lower end and parallel guides (not shown) appropriate for the well head profile (e.g., an 18⅝ inch end for a 18¾ inch well head profile). Tube 30 extends above the base plate to an upper plate 31. This upper plate has, below it, chamfered corner posts 32 and the top of the plate has a connector hub 33 for a blow out preventer (not shown) to lock onto. For example the top of the plate may have an 18¾ inch well head profile. The upper plate has four corner posts 34 to guide the blowout preventer onto the extension spool if the system is being used in guide wire depths. Alternatively, a cone guidance system could be used with a guidelineless BOP.

FIG. 6 also shows connector mechanical unlocks 35 running the length of the extension spool and soft landing jacks. One is shown at 36, the other is on the opposite side.

In FIG. 7 the blowout preventer 37 is shown. It will be seen that is too large to fit into a bay of the template. The use of the extension spool allows it, however, to sit above the template.

The extention spool may be assembled in the drilling rig by placing the lower plate 28 on the BOP beams, suspending the upper plate 31 from the BOP crane and running tubing 30 through the rotary table so that it is made up to the lower plate and locked to the upper plate.

FIG. 8 shows, diagramatically, a pipework assembly with four manifold selector heads 38 each with connections to pipes 39 and 40 designed to carry respectively; production oil, and injection water. Parallel with these main oil and water lines are smaller lines (not shown) for chemical fluid and test fluid.

FIG. 9 shows, in part section, a manifold selector head. The manifold selector head body 41 has fixed to it a generally cylindrical tube 42. Within this tube 42 is a sleeve 43 with seals 44 at appropriate points between it and tube 42. Sleeve 43 has a central pipe 45 and is formed of a main portion 46, a spider 47, and an outer portion 48.

Drilled through the tube 42 are ports 49, 50, 51, 52 connected to lines carrying respectively oil 53, water 54, chemical fluid 55 and test fluid 56. It will be seen that the water injection port 50 is below the blocked off end of sleeve 43. Oil production port 49 is, however, in communication with centre pipe 45 so the selector sleeve will allow production oil to flow. If the sleeve were, however, to be changed to one with centre pipe 45 open at the bottom and with the oil production port 49 blanked off (see FIG. 9A) the sleeve would allow water to be injected.

Port 52 for test fluid communicates with the space between the main portion 46 and the outer portion 48 of the sleeve 43 and hence with the annulus side of the selector head. Port 51 for chemical fluid communicates with a passage 57 drilled in the main portion 46 of the sleeve 43. Chemical fluid can thus enter space 58 surrounding centre tube 45 and via passage 59 to the centre tube 45. Outlets 60 and 61 are for the test and chemical fluids respectively.

FIG. 10 shows a tree module 62 with its associated tree module running tool 63.

Tree module 62 has an hydraulically-lockable connector 64 to lock it to the well head, a cubic frame 65 with corner posts 66 chamfered at top and bottom 67. Between upper and lower plates 68, 69 is the main tubing 70 with its production and annulus bores. There are upper and lower production master valves 71, 72, and upper and lower annulus master valves 73, 74 extending either side of the tubing. On one side actuating rods 75, 76 extend upwardly from the upper valves; on the other side are actuating rods 77, 78 for the lower valves. Both sets of rods are carried in racks 79, 80 and at the top of each rack are trapezoidal plates 81, 82. These plates carry also electrical and hydraulic connectors (not shown) for inspection, testing and servicing. Hydraulic lines 83, 84 run between lower and upper plates 68, 69 and there are two soft landing jacks 85, 86 below the lower plate.

The tree module running tool is releasably connected to a connector 87 at the top of tubing 70. It has a rectangular framework with chamfered corner posts 88, hydraulically driven connectors 89, 90 to the actuating rods 83, 84 of the tree module, a side guide arm 91, attachment points 92, 93 for attachment to a riser, point 92 being used for this running operation. The attachment points provide entry for a supply of hydraulic fluid. The module running tool also has soft landing jacks 85, 86 similar to those on the tree module.

FIG. 11 shows a manifold module. It is lowered and placed using the same module running tool as shown in FIG. 10. It is generally similar in design to the tree module, similar parts having the same numerals as FIG. 10. It has, however, in addition, a chemical fluid valve 94 on the production side with a vertical actuating rod 96, and a crossover valve 95 and actuating rod 97.

FIG. 12 is a three dimensional view of a production bridge, attached to the module running tool of FIG. 10.

The production bridge has an upper tree block 98, and upper manifold block 99. Each has a chamfered post framework 100, 101 similar to those of the tree and manifold modules and hydraulically-lockable connectors 102, 103 for connection to the tree and manifold modules respectively. Upper tree block is rigid with framework 104, while upper manifold block is supported loosely by it. Production and annulus pipes 105, 106 connect the two blocks. These have a certain flexibility and are the only direct connection between the blocks. A member 107 attached to the upper well block completes the template framework when the production bridge is in position. On the upper tree block are production and annulus swab compact valves 108, 109 with associated mechanism for vertical actuator rods 110, 111. There may also be a production wing valve (not shown). The running tool is releasably connected to the upper hub of the upper tree block. Attachment point 93 of the running tool is used to keep the attachment point of the tool with the riser pipe over the centre of gravity of the bridge.

Inserted into the upper manifold block is an insert choke 112, releasably connected to it. There are hydraulic lines on both blocks as appropriate. The upper manifold block also has electrical connectors (not shown) and high and low pressure hydraulic connectors (not shown) to supply hydraulic fluids to the system, the high pressure fluid being for the main down hole functions and the low pressure fluid being for the production system.

The frameworks of both blocks are shaped on two sides so that the bridge may fit between the racks 79, 80 and trapezoidal upper plates 81, 82 of the main tree and manifold modules.

There are hydraulic lines as appropriate in both blocks and also soft landing jacks 85, 86.

High and low pressure hydraulic control lines enter upper manifold block at point 113 and the hydraulic fluid is fed to the two upper blocks and high pressure cap (see FIG. 13) and the two lower modules of the system passing across each interface through hydraulic junction plates (see FIG. 14).

The insert choke 112 has a running hub 129.

FIG. 13 shows a high pressure cap 116 which is hydraulically locked onto the top of the upper well tree block. It has soft landing jacks 132 which are similar to but smaller than the jacks 85, 86 shown on previous modules and blocks. It is lowered and placed by a component running tool 117, which is generally smaller and simpler than the module running tool used to install the main modules. It has, however, a similar chamfered corner post framework 118 and suitable hydraulic lines and connections. The same component running tool 117 may also be used to remove the insert choke 112 on the upper manifold block and replace it with another choke. Hydraulic drives 131 are for operating the HP cap 116 or insert choke 112 connectors.

FIG. 14 shows the assembled production system, with the parts having the same numbering as in the previous figures. The template frame 15, 16, 17 has well slot 19 and manifold slot 20. The well itself 119 has the usual casing. Above the well head 120 is the tree module 121, and the upper tree block 98 of the production bridge with HP cap 116 on top. Above the manifold slot is the manifold selector head 38, manifold module 122, and the upper manifold block 99 of the production bridge with the choke 112 on top.

Additional detail is shown in FIG. 14 of the HP cap 116 and insert choke 112. The HP cap has a running hub 115 with a hydraulic connector. There is a similar hub 129 on the insert choke but this hub has an additional rotatable portion on top so that the choke stem position can be changed by ROV. Connector override rods 130 allow for mechanical operation of the connectors of the cap to the upper tree block and of the connectors of the choke to the upper manifold block.

Also shown in FIG. 14 are the hydraulic junction plates 114 between HP cap and upper tree block, between upper tree block and tree module, and between upper manifold block and manifold modules.

FIGS. 15 and 16 are side and rear elevations of a remotely operated vehicle. The ROV perches on a raised guide 23 of a cover 22 using box section guide members 123, 124 to position it. These box section guide members can rotate through 90° being stored flat beneath the ROV body when not in use, and rotated down to fit either side of the raised cover guide 23 when in use. These box section guide members can be rotated and locked in position by hydraulic cylinders 125.

The main ROV body 126 has two operating arms 127, 128 extending sideways from the body so that they are over an adjacent module for whatever inspection, testing or servicing functions are required. The ROV can be moved lengthwise along the raised guide 23 to reach any actuating rod or point on either the well or manifold assemblies using appropriate tooling.

The above description has been based on the sequence of steps for the installation of a sub-sea production system. Since, however, the system is modular and since each component part is releasably locked to each other, it follows that the system could be dis-assembled in the reverse order, using a drilling rig, to allow any of its component parts to be removed for repair or replacement.

I claim:

1. A template for a subsea oil production system having a three-dimensional framework of vertical and horizontal members enclosing one or more rectangular production bays, each bay having a well slot and a manifold slot, said vertical and horizontal members of the framework defining, within each production bay, space above each well slot for a tree module, space above each manifold slot for a manifold module, and space above the modules for a production bridge module linking the other modules.

2. A template as claimed in claim 1 having moveable covers above each bay, the covers having raised guides capable of locating a remotely operated vehicle.

3. A template as claimed in claim 1 or 2 having also an extension spool fitting within the framework above a well slot, said spool being adapted to receive a blow-out preventor above it and the template framework.

4. A subsea oil production system comprising a template as claimed in claim 1, a well head and tree module above each well slot, a manifold selector head and manifold module above each manifold slot and a production bridge formed of an upper tree block and an upper manifold block with piping connecting the blocks, all activating and control points of all the parts being at the top of the well and manifold assemblies.

5. A subsea oil production system as claimed in claim 4 wherein the tree module and manifold module have valves extending sideways at 90° to the axis of the production bay in which they are placed, and the upper tree and upper manifold blocks have valves extending sideways parallel to the axis of the production bay.

6. A subsea production system as claimed in claim 4, having also a unitary pipework assembly linking each manifold selector head, capable of taking oil away from and bringing fluids into the production system.

7. A subsea production system as claimed in claim 4, wherein each manifold selector head has a sleeve adapted to allow the adjacent well to be used either for oil production or water injection.

8. A subsea production system as claimed in claim 4, having also a module running tool for installing each tree module, manifold module and production bridge module.

9. A subsea production system as claimed in claim 4 wherein each tree module, manifold module, upper tree block and upper manifold block have a rectangular framework of chamfered corner posts to align and orientate said parts with the template framework during installation.

10. A subsea production system as claimed in claim 4 having a high pressure cap on top of the upper tree block and a choke on top of the upper manifold block and a component running tool for installing the high pressure cap and, if necessary, for changing the choke.

11. A sub-sea production system as claimed in claim 4 wherein the top of the three dimensional framework has covers hinged to horizontal members of the framework to cover each production bay, said covers having raised guides thereupon, and wherein the system includes a remotely operated vehicle which is adapted to perch on the raised guides of a cover and which has side arms for activating or controlling any of the functions of the assemblies of an adjacent bay.

* * * * *